US009435544B2

(12) United States Patent
Serrar

(10) Patent No.: US 9,435,544 B2
(45) Date of Patent: Sep. 6, 2016

(54) METHOD AND APPARATUS FOR BURNING SOLID FUELS BY RADIATIVE COMBUSTION

(71) Applicant: Mouhsine Serrar, Oakland, CA (US)

(72) Inventor: Mouhsine Serrar, Oakland, CA (US)

(73) Assignee: Prakti Pte. Ltd., Singapore (SG)

( * ) Notice: Subject to any disclaimer, the term of this patent is extended or adjusted under 35 U.S.C. 154(b) by 608 days.

(21) Appl. No.: 13/918,765

(22) Filed: Jun. 14, 2013

(65) Prior Publication Data

US 2013/0333683 A1 Dec. 19, 2013

Related U.S. Application Data

(60) Provisional application No. 61/660,579, filed on Jun. 15, 2012.

(51) Int. Cl.
*F24B 13/00* (2006.01)
*F24B 1/22* (2006.01)
*F24B 13/02* (2006.01)

(52) U.S. Cl.
CPC ..... *F24B 13/00* (2013.01); *F24B 1/22* (2013.01); *F24B 13/02* (2013.01)

(58) Field of Classification Search
USPC ..... 126/19 R, 9 A; 431/6
See application file for complete search history.

(56) References Cited

U.S. PATENT DOCUMENTS 3,279,453 A * 10/1966 Norehad ..... A47J 37/0768 126/25 B
4,375,215 A 3/1983 Koppe
4,503,835 A 3/1985 Williams
4,579,525 A 4/1986 Ross
5,293,859 A * 3/1994 Lisker ..... A47J 37/0768 126/25 A
6,158,425 A * 12/2000 Kim ..... A47J 37/0768 126/25 B
6,314,955 B1 11/2001 Boetcker
6,595,199 B1 7/2003 Andersen et al.
7,204,864 B2 * 4/2007 Stephens ..... C10L 5/36 44/530
D612,662 S 3/2010 Lorenz et al.
D640,497 S 6/2011 Lorenz et al.
2006/0096162 A1 * 5/2006 Contreras ..... C10L 5/14 44/550

OTHER PUBLICATIONS

Bairiganjan et al. (2010). "Power to the people—Investing in clean energy for the base of the pyramid in India," Center for Development Finance of Institute for Finance and Management Research and World Resources Institute Report, 74 pages.
Bruce et al. (2002). "The health effects of indoor air pollution exposure in developing countries," WHO report, 41 pages.
Bryden et al. (2002) "Design principles for wood burning cook stoves," Aprovecho Research Center, 40 pages.
Bryden et al. (2005) "Comparing cooking stoves [Draft]," Aprovecho Research Center, 94 pages.
Duflo et al. (2008). "Cooking stoves, indoor air pollution and respiratory health in India," joint study by J-PAL of MIT and CMR of IFMR, 10 pages.

(Continued)

*Primary Examiner* — Avinash Savani
(74) *Attorney, Agent, or Firm* — Morrison & Foerster LLP

(57) ABSTRACT

A method and an apparatus for burning biomass briquettes are provided. The method described herein can create a fire from burning solid biomass that reduces the amount of smoke and harmful gas emissions (e.g., carbon monoxide), increases output power, and improves the combustion of the briquettes used as a solid fuel in a cooking apparatus (e.g., a cooking stove).

20 Claims, 6 Drawing Sheets

(56) References Cited

OTHER PUBLICATIONS

E. Duflo et al. (2010). "Indoor air pollution, health, and economic well-being," MIT, 22 pages.
Global Alliance for Clean Cookstoves, (Nov. 2011) "Igniting change: A strategy for universal adoption of clean cookstoves and fuels," 56 pages.
Klingshim (2005). "Solar cookers for UNHCR refugee projects?" GTZ, 47 pages.
MART Rural Solutions (2006). "Report on market testing of 5 stoves prototypes in Kamataka and Tamil Nadu," 57 pages.
Olsen and Mehta (2006). "Female labour participation in rural and urban India: Does housewives' work count?" Radical Statistics (93), 39 pages.
Shrimali et al. (2010). "Improved stoves in India: a study of business models," Energy Policy, article in press, 14 pages.
Simanis and Hart (2008). "Base of the pyramid protocol 2.0," 57 pages.
Smith, Kirk (2000). "National burden in India from indoor air pollution," PNAS 97(24):13286-13293.
Venkataraman et al. (2010). "The Indian national initiative for advanced biomass cookstoves: The benefits of clean combustion," Energy for Sustainable Development 14:63-72.
Warwick and Doig (2004). "Smoke—the killer in the kitchen: Indoor air pollution in developing countries," Practical Action, ITGD, 47 pages.
Westhoff and Germann (1995). "Stove images—A documentation of improved and traditional stoves in Africa, Asia and Latin America," GTZ, 219 pages.
World Health Organization (2006). "Indoor air pollution, health, and the burden of disease," WHO briefing, 4 pages.
World Health Organization (2009). "The energy access situation in developing countries," WHO & UNDP Sustainable Energy Program paper, 142 pages.

* cited by examiner

METHOD AND APPARATUS FOR BURNING SOLID FUELS BY RADIATIVE COMBUSTION

CROSS-REFERENCE TO RELATED APPLICATIONS

This application claims the benefit of U.S. provisional patent application Ser. No. 61/660,579, filed Jun. 15, 2012, the disclosure of which is hereby incorporated by reference in its entirety.

FIELD

The present disclosure relates generally cooking stoves, and more specifically to cooking stoves that can burn briquettes made out of solid biomass.

BACKGROUND

Today, around three billion people in developing countries cook with solid biomass (e.g., wood, recycled agricultural waste or urban waste). The burning of biomass in existing cooking stoves available to those in developing countries typically emits a significant amount of smoke, carbon dioxide and carbon monoxide. Every day, the equivalent of ten million trees is burned for cooking, while over four million tons of carbon dioxide is released into the air. Not only do inefficient cooking stoves harm the environment by contributing to deforestation and global warming, the toxic emissions released from cooking fires kills 1.6 million people every year in developing countries.

Traditional cooking stoves used in developing countries are generally fuel-inefficient, consuming at least twice the necessary fuel. In fuel-scarce areas within development countries, households will often spend up to 40% of their income on fuel. Women may spend as much as four hours every day collecting wood.

Moreover, cooking stoves used in developing countries typically burn biomass as a source of energy. For example, unprocessed wood is typically used in cooking stoves in developing countries. Solid biomass can also be industrially pressed into a dense briquette for use in the cooking stoves; however, industrial briquette production uses heavy machinery, such as extruders or presses, which require high power to run, as well as capital investment and technical capacity in terms of installation, operation and maintenance of equipment, which is not readily available to those in developing countries. Hand-pressed biomass forms low-density briquettes, which typically release too much smoke when burned using conventional cooking stoves. Low-density briquettes typically produce a low amount of power, thereby making this type of briquette inefficient for use in a cooking apparatus.

Thus, what is needed in the art is a cooking stove and a method for burn briquettes made from biomass that consumes less fuel, reduces cooking time, and reduces harmful emissions.

BRIEF SUMMARY

The present disclosure addresses this need by providing a method and an apparatus for burning solid biomass that reduces the amount of smoke and harmful gas emissions, increases output power, and improves the combustion of the briquettes used as a solid fuel in a cooking stove.

In one aspect, provided is a method for burning biomass briquettes, by: a) providing two or more biomass briquettes, in which each biomass briquette has two main faces and one or more side faces; b) arranging the two or more biomass briquettes in one or more rows to increase heat exchange between adjacent biomass briquettes, in which a main face of one biomass briquette is arranged parallel to a main face of an adjacent biomass briquette in each row, in which a space exists between adjacent biomass briquettes in each row, and in which the space between adjacent biomass briquettes in each row is between 1 mm and 50 mm; c) igniting at least one biomass briquette; and d) creating a fire from burning the two or more biomass briquettes.

In some embodiments, the two or more biomass briquettes are cylindrical briquettes, with two main faces and one side face. In other embodiments, the two or more biomass briquettes are rectangular briquettes, with two main faces and four side faces.

In certain embodiments, each biomass briquette independently has a density of less than 0.6 g/cm$^3$, or between 0.1 g/cm$^3$ and 0.5 g/cm$^3$, or about 0.3 g/cm$^3$. The space between adjacent biomass may also vary. In some embodiments, the space between adjacent biomass briquettes is between 5 mm and 30 mm, or between 5 mm and 15 mm.

Each biomass briquette may be independently made up of urban waste, agricultural waste, or a combination thereof. The urban waste may include paper, cardboard, and sawdust, or a combination thereof. The agricultural waste may include animal processing waste, cellulosic materials, or a combination thereof.

In some embodiments, the method produces a fire having a temperature of at least 500° C., at least 1000° C., or between 500° C. and 1000° C., or between 500° C. and 800° C., or between 500° C. and 600° C.

Provided is also a cooking apparatus that includes:

- a combustion chamber;
- an air inlet, in which the air inlet controls the flow of air into the combustion chamber;
- a briquette platform, in which the briquette platform is located inside the combustion chamber;
- two or more biomass briquettes, in which the two or more biomass briquettes are arranged on the briquette platform in one or more rows to increase heat exchange between adjacent biomass briquettes in each row; and
- a cooking housing, in which the cooking housing sits above the combustion chamber.

Each biomass briquette has two main faces and one or more side faces. In some embodiments, the two or more biomass briquettes are cylindrical briquettes, with two main faces and one side face. In other embodiments, the two or more biomass briquettes are rectangular briquettes, with two main faces and four side faces. A main face of one biomass briquette is arranged parallel to a main face of an adjacent biomass briquette in each row. A space exists between adjacent biomass briquettes in each row, and the space between adjacent biomass briquettes in each row may be between 1 mm and 50 mm, 5 mm and 30 mm, or between 5 mm and 15 mm.

In some embodiments, the briquette platform has one or more holes to control airflow. The apparatus may also include a briquette tray, which may be placed on top of the briquette platform inside the combustion chamber, and the two or more biomass briquettes are arranged on the briquette tray.

The cooking housing may be configured to receive a cooking utensil selected from the group consisting of a cooking plate, a grill, a pot, a wok, and a Dutch oven. When the method described above is employed, the temperature inside the combustion chamber may be at least 500° C., at least 1000° C., or between 500° C. and 1000° C., or between 500° C. and 800° C., or between 500° C. and 600° C.

DESCRIPTION OF THE FIGURES

The present application can be best understood by reference to the following description taken in conjunction with the accompany drawing figures, in which like parts may be referred to by like numerals:

FIGS. 3A and 3B depict a side view of an exemplary method of burning cylindrical briquettes, in which FIG. 3A depicts the briquettes before combustion and FIG. 3B depicts the briquettes during combustion.

DETAILED DESCRIPTION

The following description sets forth numerous specific configurations, parameters, and the like. It should be recognized, however, that such description is not intended as a limitation on the scope of the present disclosure but is instead provided as a description of exemplary embodiments.

The following description relates primarily to a method for burning briquettes made out of biomass. In some embodiments, the briquettes are low-density briquettes made from biomass. In one embodiment, low-density briquettes may have a density of less than 0.6 g/cm$^3$. In other embodiments, low-density briquettes may have a density between 0.1 g/cm$^3$ and 0.5 g/cm$^3$. The method described herein can create a fire that reduces the amount of smoke and harmful gas emissions (e.g., carbon monoxide), and improves the combustion of the briquettes used as a solid fuel in a cooking apparatus (e.g., a cooking stove).

Figures 1A, 1B:
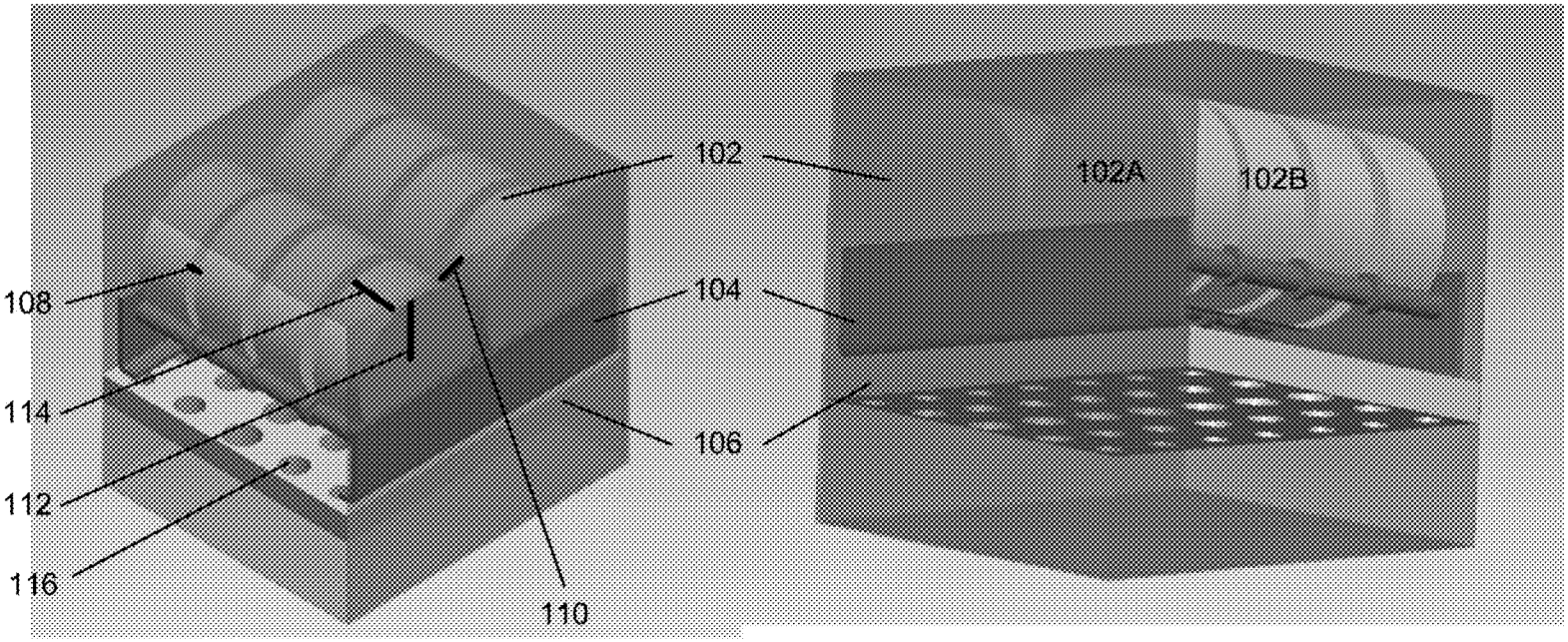
FIGS. 1A and 1B depict an exemplary arrangement of cylindrical briquettes held in place by a briquette tray, in which the briquette tray rests on a briquette platform.

FIGS. 1 and 2 depict exemplary arrangements of briquettes that can be used in the method and apparatus described herein. With reference to FIGS. 1A and 1B, cylindrical briquettes 102 are placed in briquette tray 104, which hold the briquettes in place for combustion. Briquette 102 has two main faces 102A and one side face 102B. Briquette tray 104 rests on top of briquette platform 106, which raises the briquette tray above ground level and has one or more pores to control air flow and combustion.

The briquettes used in the method and apparatus described herein typically include urban waste and/or agricultural waste. Urban waste may include, for example, paper, cardboard, and/or sawdust. Agricultural waste may include, for example, animal processing waste (e.g., manure) and/or cellulosic materials (e.g., rice husks, corn, corn cobb, coffee husk, sugar cane waste, pine needles, dry leafs, or other forest waste). A combination of waste materials may also be used to prepare the briquettes.

In certain embodiments, the briquettes used in the method and apparatus described herein may be hand-pressed. The waste materials described above can be mixed and compressed into a briquette using a briquette press or a lever system. In some embodiments, the briquettes used herein are made from urban waste, for example, ⅓ paper, ⅓ cardboard, ⅓ saw dust. These materials can be soaked in water for 24 hours to become soft and easy to mix, and then mixed while wet. Once mixed, they can be placed in molds to be pressed to expel extra water and increase density. Last, the briquettes can be left to dry in the sun for few days to gain strength and to minimize humidity in the briquettes.

Hand-pressed briquettes used in the method and apparatus described herein have a lower density than other solid fuel sources such as wood or industrial briquettes. For example, wood has a density of about 0.6 g/cm$^3$. Industrial briquettes that are mechanically compressed and typically have a density of at least 1 g/cm$^3$. In contrast, the briquettes used herein have a lower density. In some embodiments, the briquettes have a density less than 0.6 g/cm$^3$. In other embodiments, the briquettes have a density between 0.1 g/cm$^3$ and 0.5 g/cm$^3$. In an exemplary embodiment, the briquettes have a density about 0.3 g/cm$^3$. It should be understood, however, that the method and apparatus described herein may burn briquettes made using any methods known in the art, including, for example, industrial briquettes.

Briquette tray 104 holds the briquettes in place, so as to increase heat exchange between adjacent briquettes within a row, thereby improving combustion. With reference again to FIGS. 1A and 1B, briquette tray 104 is particularly useful to hold cylindrical briquettes in place. Briquette tray 104 may be made of any combustion-resistant material including, for example, cast iron, steal or ceramic.

Figure 1C:
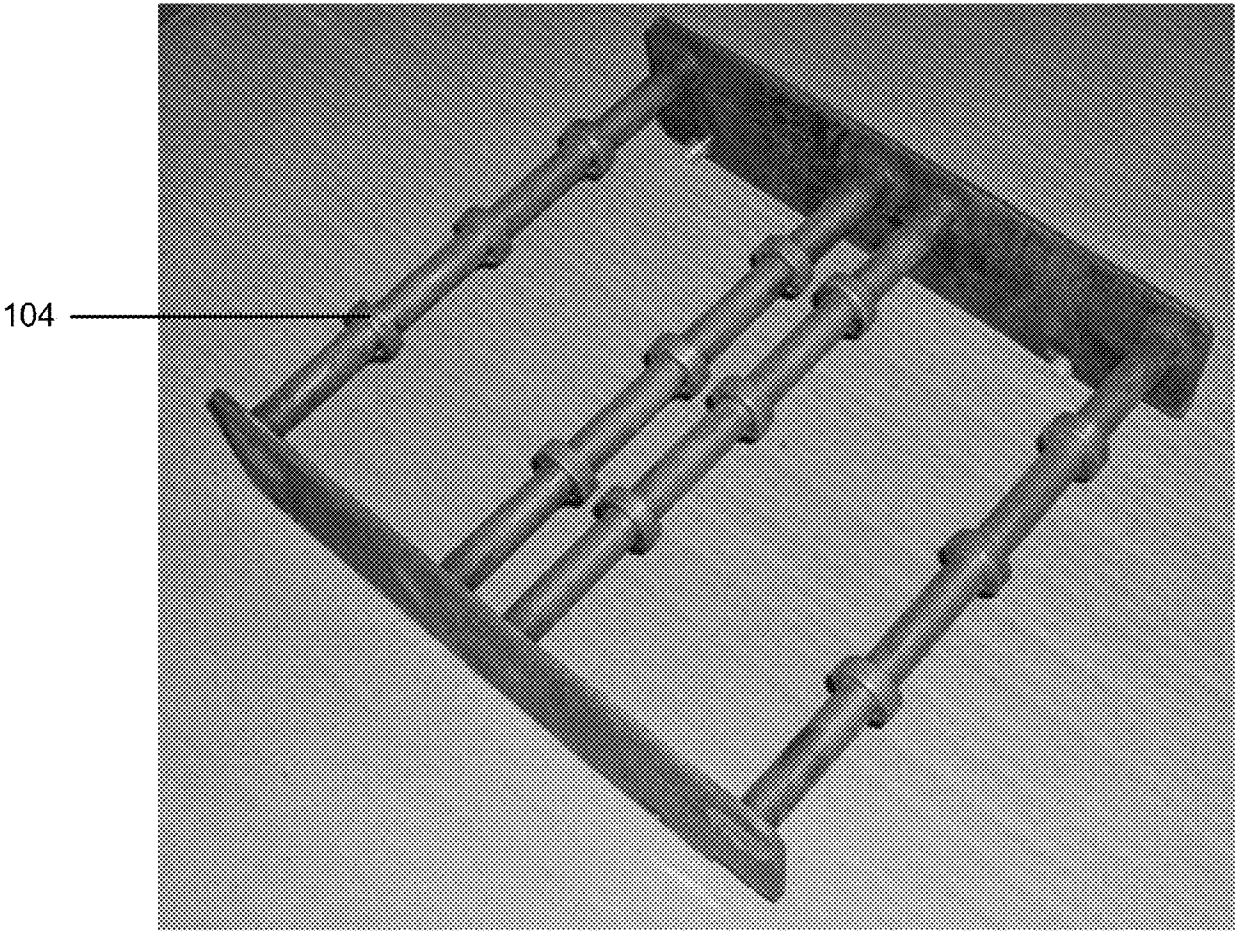
FIG. 1C depicts an exemplary briquette tray.

With reference to FIG. 1C, in an exemplary embodiment, briquette tray 104 can hold eight briquettes in two rows, in which four briquettes are arranged side-by-side in each row. It should be understood, however, that other exemplary briquette trays may holder fewer or more briquettes. Moreover, briquette tray 104 may hold two or more briquettes in one or multiple rows. The method and apparatus described herein use at least two or more briquettes.

With reference again to FIG. 1A, cylindrical briquettes 102 are arranged on briquette tray 104 so that space 108 allows air flow between briquettes, which provides oxygen necessary for combustion of the briquette faces. Space 108 allows maximal heat exchange between briquette faces.

It should be understood, however, that optimal space 108 may vary depending on the composition of the briquette, the briquette density, and stove design. In some embodiments, space 108 is less than 1 cm, 50 mm, 30 mm, 20 mm, 15 mm, 10 mm, or 5 mm. In other embodiments, space 108 is about 1-30 mm, 1-15 mm, 5-10 nm, 5-30 mm, or 5-15 mm.

With reference again to FIG. 1A, cylindrical briquettes 102 are arranged on briquette tray 104 so that a main face of one cylindrical briquette is parallel to a main face of an adjacent briquette in a given row. The cylindrical briquettes in the different rows do not collide against each other, such that there is a space 110. In some embodiments, space 110 is less than 1 cm, 50 mm, 20 mm, 15 mm, 10 mm, or 5 mm. In other embodiments, space 110 is about 1-20 mm, 1-15 mm, 5-10 mm, 5-20 mm, or 5-15 mm. It should be understood that space 110 may not exist in other exemplary embodiments where there is only one row of two or more briquettes, or where square or rectangular briquettes are used.

Spaces 108 can be optimized to control air flowing between adjacent briquettes. Improved air flow between the briquettes help improve the radiative combustion of the briquettes, which reduces smoke and increases the temperature of the fire. In some embodiments, radiative combustion refers to the transfer of heat from one main face of a briquette that is burning to the opposite main face of an adjacent briquette.

Briquette platform 106 can further control air flowing between the briquettes by raising briquette tray 104 above the ground. With reference to FIG. 1A, briquette platform 106 has multiple pores 116. The pores of the briquette platform can be of any size and shape. The pores may, for example, be round or rectangular slots. In certain embodiments in which the pores are round, the pores may have a diameter between about 20 mm to about 50 mm.

Briquette platform 106 may be made of different materials including, for example, cast iron, steel, or ceramics.

With reference again to FIGS. 1A and 1B, briquette tray 104 rests on top of briquette platform 106 to improve air flowing upwards from the ground or the bottom of a cooking apparatus through the spaces between the briquettes. It should be understood, however, that in other exemplary embodiments, briquette tray 104 is optional.

Figure 2B:
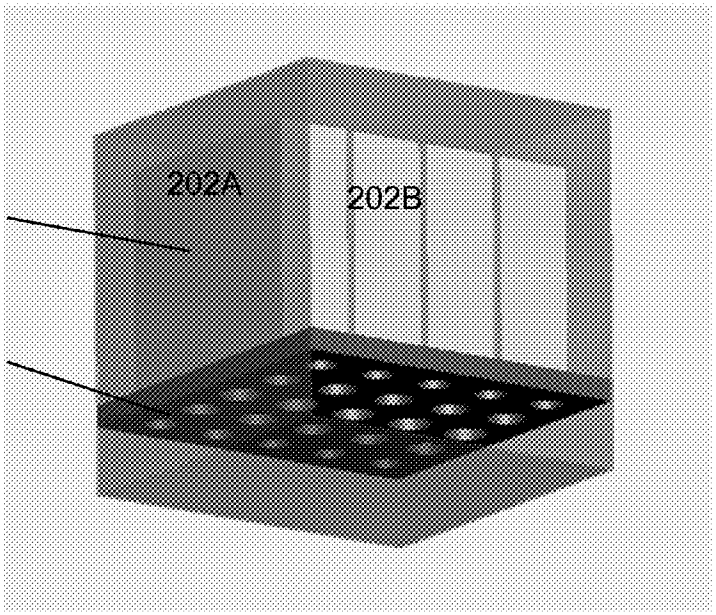
FIGS. 2A and 2B depict an exemplary arrangement of rectangular briquettes on a briquette platform.
Figure 2A:
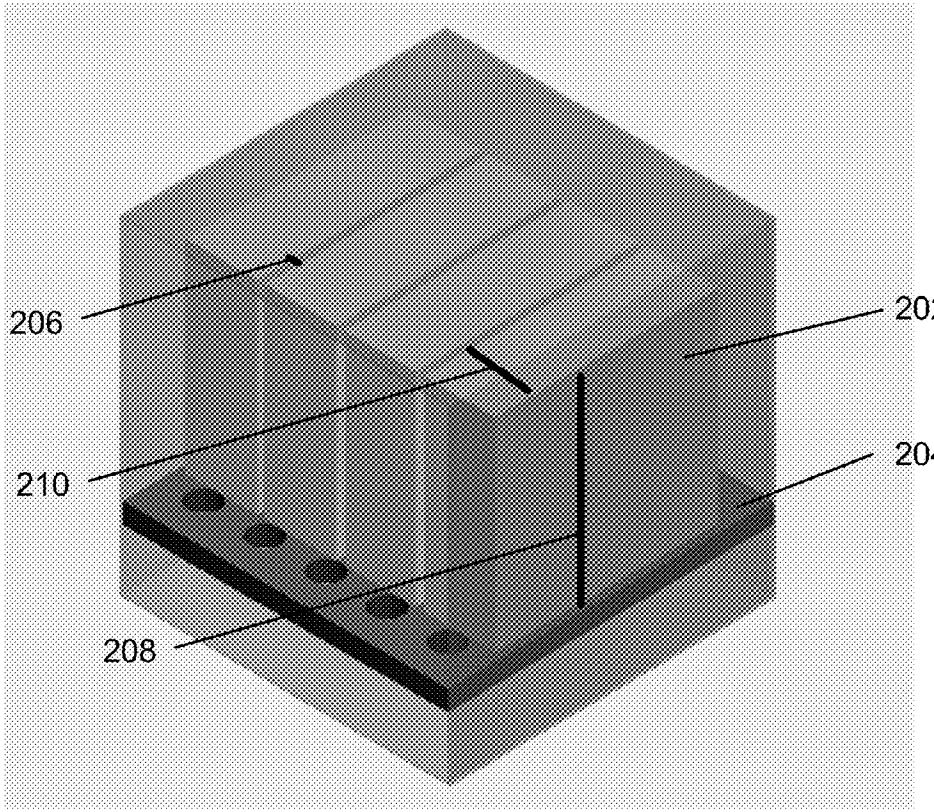

With reference to FIGS. 2A and 2B, in another exemplary arrangement, rectangular briquettes 202 are arranged side-by-side directly on briquette platform 204. Briquette 202 has two main faces 202A and four side faces 202B. It should be understood that when rectangular briquettes are used in the methods described herein, the use of a briquette tray is optional.

Briquettes 202 are arranged in one row, so that a main face of one rectangular briquette is parallel to a main face on an adjacent briquette in the row. Space 206 allows air flow between briquettes, which provides oxygen necessary for combustion of the briquette faces. Space 206 allows maximal heat exchange between briquette faces. It should be understood, however, that optimal space 206 may vary depending on the briquettes recipe, briquettes density, and stove design. In some embodiments, space 206 is less than 1 cm, 50 mm, 30 mm, 20 mm, 15 mm, 10 mm, or 5 mm. In other embodiments, space 206 is about 1-30 mm, 1-15 mm, 5-10 nm, 5-30 mm, or 5-15 mm.

While FIGS. 1A and 1B depict the use of cylindrical briquettes and FIGS. 2A and 2B depict the use of rectangular briquettes, it should be understood that the briquettes used in the method and the apparatus described herein may be of any size and/or shape. It should be understood that the size of the briquettes used in the method and apparatus described may vary depending on the desired size of the fire, or the size of the apparatus (e.g., the cooking stove).

For example, cylindrical briquettes 102 typically have radius 112 of 10 cm, and width 114 of 3 cm. In other embodiments, radius 112 is about 6 cm, 8 cm, 12 cm or 14 cm. In other embodiments, width 114 is about 1 cm, 2 cm, 4 cm or 5 cm.

In another example, rectangular briquettes 202 typically have height 208 of 10 cm, and width 210 of 10 cm. In other embodiments, height 208 is about 6 cm, 8 cm, 12 cm or 14 cm. In other embodiments, width 210 is about 6 cm, 8 cm, 12 cm or 14 cm.

In yet other embodiments, the briquettes may be hand-pressed and may have an irregular shape.

Figure 3A:
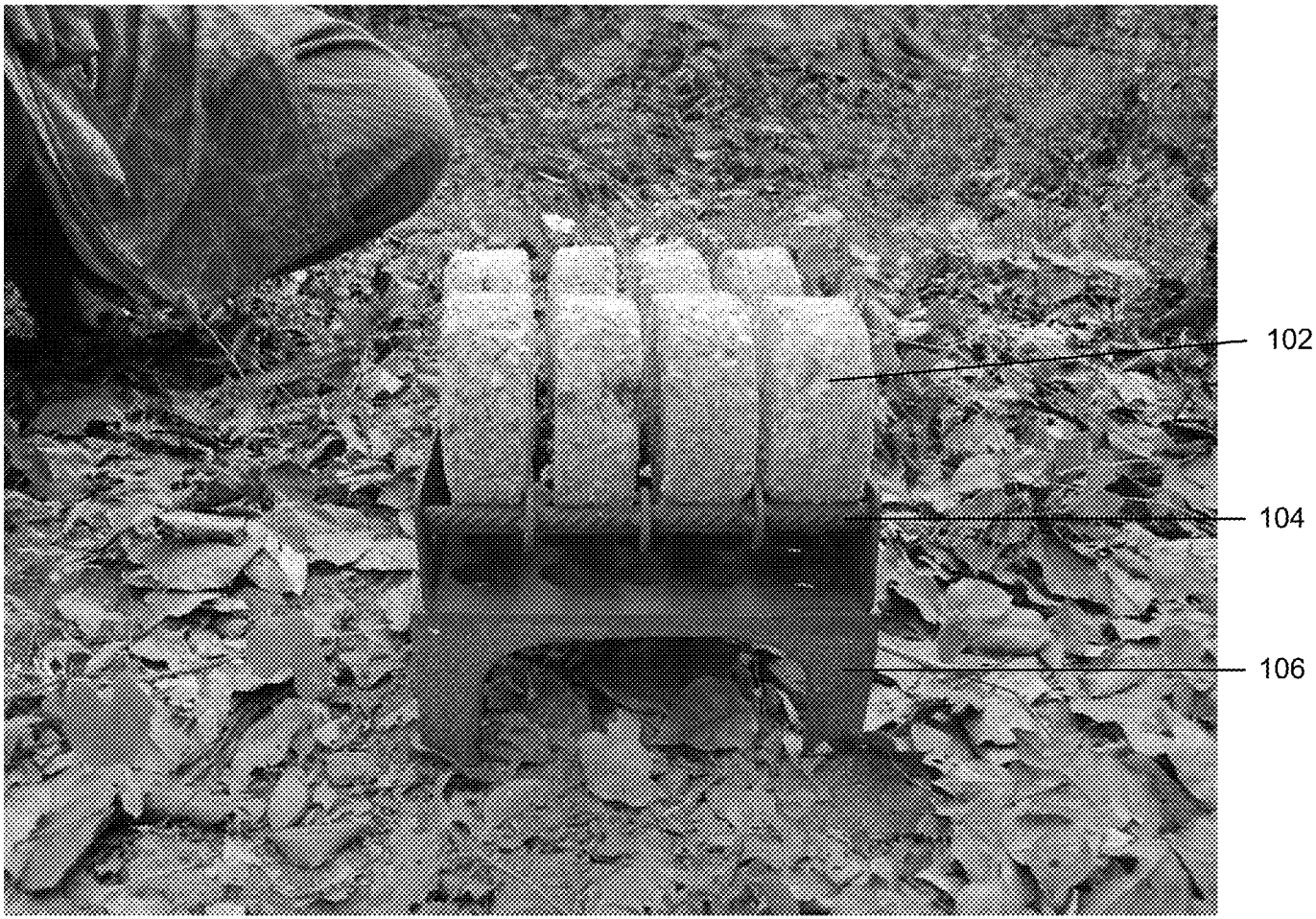
Figure 3B:
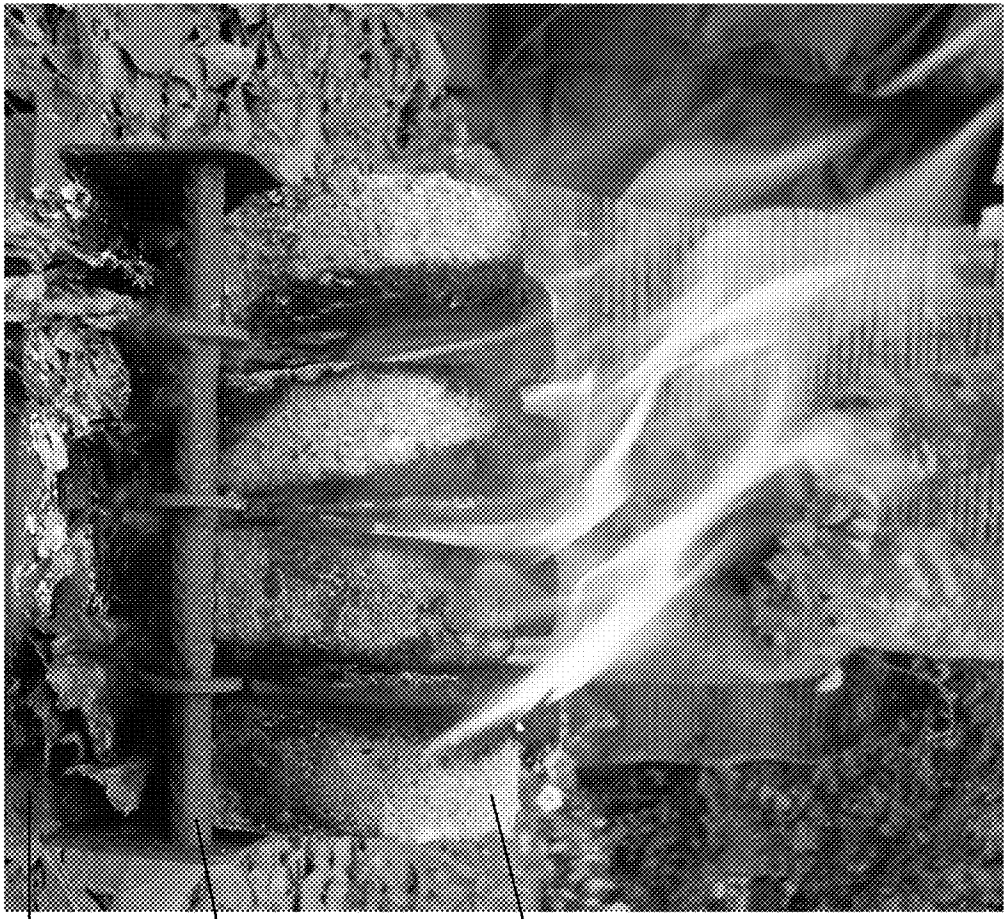

An exemplary method for burning low-density briquettes is illustrated in FIGS. 3A and 3B. With reference to FIG. 3A, eight cylindrical briquettes 102, hand-pressed from urban waste materials, are arranged in two rows on briquette tray 104. Adjacent briquettes within each row are arranged about 10-15 mm apart and adjacent rows of briquettes are also arranged about 10-15 mm apart. Briquette tray 104 rests on briquette platform 106, which raises the briquette tray several inches above the ground.

Raising briquette tray 104 several inches above the ground allows for better control of air flow between briquettes. Specifically, this arrangement allows for improved mixing and proportion of combustion gases such combustible gases from the fuel and oxygen in the air, which in turn improves combustion.

Briquettes 102 may be ignited by any methods known in the art. For example, with reference to FIG. 3B, briquettes 102 can be ignited from the bottom by placing a starter material, such as paper, in the space between briquette tray 104 and briquette platform 106. In other exemplary embodiments, one or more briquettes may be ignited using twigs, kerosene, or other combustible materials. Further, it should be understood that the one or more briquettes may be ignited from the bottom, the top, or both.

Figures 4A, 4B:
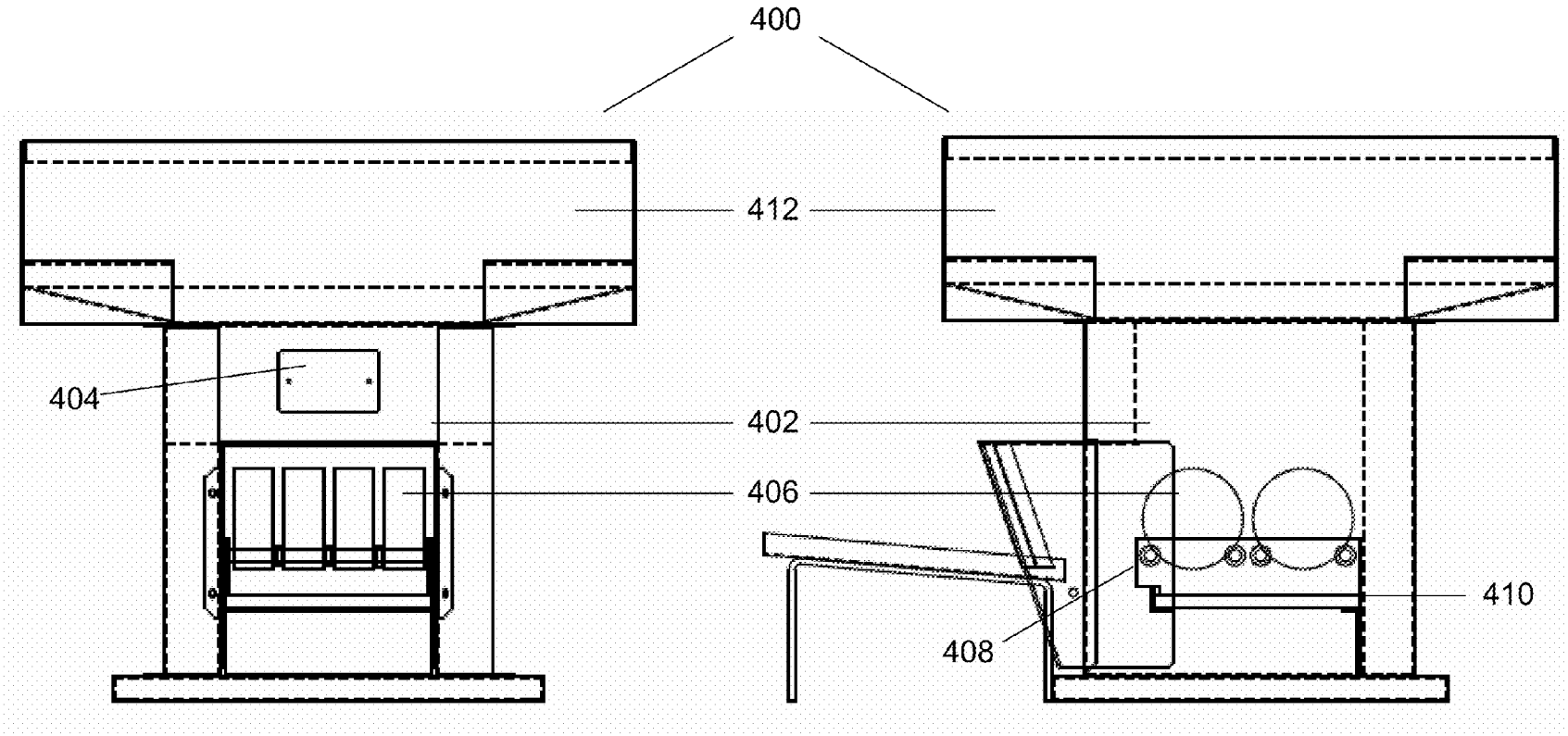
FIGS. 4A and 4B depict front and side views, respectively, of an exemplary cooking stove configured to burn briquettes based from biomass.

An exemplary cooking apparatus that employs the method described herein is illustrated in FIGS. 4A and 4B. As described below, apparatus 400 includes combustion chamber 402, which may be made of a combination of insulative and refractory material and may be different size to accommodate the desired heating power of the stove.

Air inlet 404 controls the air flow into the combustion chamber, which can be used to improve combustion efficiency. Eight cylindrical briquettes 406 are arranged on briquette platform 408, which sits inside combustion chamber 402. Apparatus 400 includes briquette tray 408, which sits on briquette platform 410. Briquette tray 408 can be useful to hold cylindrical briquettes or irregularly-shaped briquettes in place. In other exemplary embodiments, for example when rectangular briquettes are used, the briquette tray may be optional and rectangular briquettes may be arranged directly on the briquette platform.

As discussed above, briquettes 406 are arranged side-by-side in one or more rows, depending on the size of the cooking apparatus, to increase heat exchange between briquettes. In some embodiments, the briquettes are arranged so to exceed 500° C. inside the combustion chamber when burned.

Cooking housing 412 sits above the combustion chamber, and is configured to receive a cooking utensil such as, for example, a cooking plate, a grill, a pot, a wok, or a Dutch oven.

In some embodiments, the average combustion power generated using the method described herein is at least 2, at least 3, at least 4, at least 5 or at least 10 times the average combustion power generated compared to when the briquettes are arranged randomly. In certain embodiments, the average combustion power generated using the method described herein is at least 10 kW, at least 15 kW, at least 20 kW, at least 25 kW, or at least 30 kW.

In other embodiments, the average power generated using the method described herein is at least 2, at least 3, at least 4, at least 5 or at least 10 times the average power achieved generated compared to when the briquettes are arranged randomly. In certain embodiments, the average power generated is at least 3 kW, at least 4 kW, at least 5 kW, at least 6 kW, at least 7 kW, at least 8 kW, at least 9 W, or at least 10 kW. In other embodiments, the average power generated is between 3 and 10 kW, or between 5 and 8 kW.

In yet other embodiments, the method described herein can generate enough power to raise the temperature of water to at least 70° C., at least 80° C., at least 90° C., or at least 100° C. In certain embodiments, the method described herein can generate enough power to raise the temperature of water between 70° C. and 110° C., or between 80° C. and 105° C., or between 90° C. and 100° C.

In yet other embodiments, the method described herein can generate enough power to bring a pot of water to boil in half the time it takes compared to when the briquettes are arranged randomly.

EXAMPLES

The following Examples are merely illustrative and are not meant to limit any aspects of the present disclosure in any way.

Example 1

Heating Power by Radiative Combustion

This example demonstrates that biomass briquettes burned in an arrangement that maximizes heat exchange by radiative combustion yields more power than biomass briquettes burned in a random arrangement.

Random Burning:

Fifteen cylindrical briquettes were positioned randomly in the combustion chamber of a cooking stove. A fire was started in the combustion chamber. An 80 L pot of water was placed on the cooking housing that sat above the combustion chamber. The temperature of the water in the pot was observed to slowly increase at an average rate of 0.7° C./min. The temperature was observed to continually increase, but the rate of increase gradually slowed down. When the temperate reached 67° C., the temperature was observed to stop increasing. The power coming out of the briquettes combustion did not appear to exceed the heat loss from the pot. The average briquettes combustion power was 8.3 KW. After the temperature reached 67° C., additional briquettes were added to the combustion chamber; however, the temperature was not observed to increase any further even when additional briquettes were added.

Radiative Combustion:

Thirty cylindrical briquettes were placed on a briquette tray in two rows. In each row, the cylindrical briquettes were arranged so that the main face of one briquette was parallel to, and about 5 mm away from, the main face of the adjacent briquette. Such an arrangement maximized radiative heat exchange between briquettes. The heating rate was observed to start much higher, at 2.2° C./min. This heating rate was nearly 3 times faster than the rate observed in the random burning experiment above. The 80 L pot of water was able to boil (i.e., reach 100° C.) in 35 minutes. The average briquettes combustion power was 28.6 KW.

Table 1 below summarizes the comparative data from the random burning experiment versus the radiative combustion experiment.

TABLE 1

Data comparing effect of random burning versus radiative combustion

| | Random Burning | Radiative Combustion |
|---|---|---|
| Amount of water (L) | 50 | 50 |
| Start Temperature (° C.) | 23 | 23 |
| End Temperature (° C.) | 67 | 100 |
| Time (min) | 60 | 35 |
| Average temperature increase (° C./min) | 0.7 | 2.2 |
| Average power delivered to pot (kW) | 2.6 | 7.7 |
| Average combustion power (kW) | 8.3 | 28.6 |

Thus, the burning of briquettes that are randomly arranged does not generate enough power to boil a pot of water. When briquettes are arranged to achieve radiative combustion, the pot of water reached boiling temperatures in half the amount of time. The average power observed in the radiative combustion experiment was surprisingly almost 3.5 times the average power observed in the random burning experiment.

What is claimed is:

1. A method for burning biomass briquettes, comprising:

a) providing two or more biomass briquettes, wherein each biomass briquette has two main faces and one or more side faces;

b) arranging the two or more biomass briquettes in one or more rows to increase heat exchange between adjacent biomass briquettes in each row, wherein each biomass briquette is placed on a side face so that a main face of one biomass briquette faces a main face of an adjacent biomass briquette in each row, wherein a space exists between the main faces of adjacent biomass briquettes in each row, and wherein the space between the main faces of adjacent biomass briquettes in each row is between 1 mm and 50 mm;

c) igniting at least one biomass briquette; and d) creating a fire from burning of the two or more biomass briquettes.

2. The method of claim 1, wherein the two or more biomass briquettes are cylindrical briquettes, wherein the cylindrical briquettes have two main faces and one side face.

3. The method of claim 1, wherein the two or more biomass briquettes are rectangular briquettes, wherein the rectangular briquettes have two main faces and four side faces.

4. The method of claim 1, wherein each biomass briquette independently has a density of less than 0.6 g/cm$^3$.

5. The method of claim 4, wherein each biomass briquette independently has a density between 0.1 g/cm$^3$ and 0.5 g/cm$^3$.

6. The method of claim 5, wherein each biomass briquette has a density of about 0.3 g/cm$^3$.

7. The method of claim 1, wherein the space between adjacent biomass briquettes is between 5 mm and 30 mm.

8. The method of claim 1, wherein each biomass briquette independently comprises urban waste, agricultural waste, or a combination thereof.

9. The method of claim 8, wherein the urban waste comprises paper, cardboard, sawdust, or a combination thereof.

10. The method of claim 8, wherein the agricultural waste comprises animal processing waste, cellulosic materials, or a combination thereof.

11. The method of claim 1, wherein the fire has a temperature of at least 500° C.

12. A cooking apparatus, comprising:

a combustion chamber;

an air inlet, wherein the air inlet controls the flow of air into the combustion chamber;

a briquette platform, wherein the briquette platform is located inside the combustion chamber configured to receive two or more biomass briquettes, wherein the two or more biomass briquettes are arranged on the briquette platform in one or more rows to increase heat exchange between adjacent biomass briquettes in each row, wherein each biomass briquette has two main faces and one or more side faces, wherein each biomass briquette is placed on a side face so that a main face of one biomass briquette faces a main face of an adjacent biomass briquette in each row, wherein a space exists between the main faces of adjacent biomass briquettes in each row, and wherein the space between the main faces of adjacent biomass briquettes in each row is between 1 mm and 50 mm; and a cooking housing, wherein the cooking housing sits above the combustion chamber.

13. The apparatus of claim 12, wherein the briquette platform comprises one or more holes to control airflow.

14. The apparatus of claim 12, wherein the space between adjacent biomass briquettes on the briquette platform is between 5 mm and 30 mm.

15. The apparatus of claim 12, further comprising a briquette tray, wherein the briquette tray is placed on top of the briquette platform inside the combustion chamber, and wherein the two or more biomass briquettes are arranged on the briquette tray.

16. The apparatus of claim 12, wherein the cooking housing is configured to receive a cooking utensil selected from the group consisting of a cooking plate, a grill, a pot, a wok, and a Dutch oven.

17. The apparatus of claim 12, wherein the temperature inside the combustion chamber is at least 500° C.

18. The apparatus of claim 12, wherein the two or more biomass briquettes comprise urban waste, agricultural waste, or a combination thereof.

19. The apparatus of claim 18, wherein the urban waste comprises paper, cardboard, sawdust, or a combination thereof.

20. The apparatus of claim 18, wherein the agricultural waste comprises animal processing waste, cellulosic materials, or a combination thereof.

* * * * *